US005604197A

United States Patent [19]

Busch et al.

[11] Patent Number: 5,604,197

[45] Date of Patent: Feb. 18, 1997

[54] SOFTENING THROUGH THE WASH COMPOSITIONS

[75] Inventors: Alfred Busch, Londerzeel; Andre C. Convents, Diegem, both of Belgium

[73] Assignee: The Procter & Gamble Company, Cincinnati, Ohio

[21] Appl. No.: 583,012

[22] PCT Filed: Jun. 22, 1994

[86] PCT No.: PCT/US94/07069

§ 371 Date: Jan. 19, 1996

§ 102(e) Date: Jan. 19, 1996

[87] PCT Pub. No.: WO95/03387

PCT Pub. Date: Feb. 2, 1995

[30] Foreign Application Priority Data

Jul. 22, 1993 [EP] European Pat. Off. ..... 93870150

[51] Int. Cl.[6] ..... D06M 15/19; C11D 3/12; C11D 3/37

[52] U.S. Cl. ..... 510/516; 510/475; 510/500; 510/507

[58] Field of Search ..... 510/516, 475, 510/500, 507

[56] References Cited

U.S. PATENT DOCUMENTS

| | | | |
|---|---|---|---|
| 4,062,647 | 12/1977 | Storm et al. | 8/137 |
| 4,548,744 | 10/1985 | Connor | 252/545 |
| 4,844,821 | 7/1989 | Mermelstein et al. | 252/8.7 |
| 5,009,980 | 4/1991 | El Sayed et al. | 430/114 |
| 5,403,906 | 4/1995 | Scriven et al. | 526/212 |
| 5,458,809 | 10/1995 | Fredj et al. | 252/542 |
| 5,458,810 | 10/1995 | Fredj et al. | 252/542 |
| 5,460,752 | 10/1995 | Fredj et al. | 252/542 |
| 5,466,802 | 11/1995 | Panandiker et al. | 544/193.2 |
| 5,470,507 | 11/1995 | Fredj et al. | 252/542 |
| 5,474,576 | 12/1995 | Thoen et al. | 8/111 |
| 5,474,699 | 12/1995 | Ahmed et al. | 252/99 |
| 5,478,489 | 12/1995 | Fredj et al. | 252/99 |

FOREIGN PATENT DOCUMENTS

| | | | |
|---|---|---|---|
| 0135217A1 | 3/1985 | European Pat. Off. | C11D 3/00 |
| 0265257A2 | 4/1988 | European Pat. Off. | C11D 3/37 |
| 0327927A2 | 8/1989 | European Pat. Off. | C11D 3/37 |
| 0508034A1 | 10/1992 | European Pat. Off. | C11D 3/37 |
| 0522206A1 | 1/1993 | European Pat. Off. | C11D 3/12 |

*Primary Examiner*—Margaret Einsmann
*Assistant Examiner*—Michael P. Tierney
*Attorney, Agent, or Firm*—Michael D. Jones; George W. Allen; Jerry J. Yetter

[57] ABSTRACT

The invention comprises a dye transfer inhibiting fabric softening composition comprising a) 0.0001% to 10% by weight of poly(4-vinylpyridine-N-oxide) having a ratio of amine to amine N-oxide of from about 2:3 to about 1:1,000,000; and b) 0.5% to 30% by weight of a fabric softening clay.

3 Claims, No Drawings

SOFTENING THROUGH THE WASH COMPOSITIONS

FIELD OF INVENTION

The present invention relates to detergent compositions containing a clay-softening system. More in particular, the present invention relates to dye transfer inhibiting compositions comprising polyamine N-oxide containing polymers and a clay-softening system.

BACKGROUND OF THE INVENTION

Clays, in particular smectite clays are known fabric-softening agents, and their use in fabric-softening through the wash has been disclosed in the art.

The relative ability of the softening clays to meet various performance criteria is among others depending on the presence of adjunct detergent ingredients. As a consequence, the detergent formulator is faced with a difficult task of providing detergent compositions which have an excellent overall performance.

One of the types of adjunct detergent ingredients that is added to detergent compositions are dye transfer inhibiting polymers. Said polymers are added to detergent compositions in order to inhibit the transfer of dyes from colored fabrics onto other fabrics washed therewith. These polymers have the ability to complex or adsorb the fugitive dyes washed out of dyed fabrics before the dyes have the opportunity to become attached to other articles in the wash.

Polymers have been used within detergent compositions to inhibit dye transfer.

Examples of such polymers are vinylpyrrolidone polymers such as described EP-A-265 257 and EP 508 034.

Unfortunately, said vinylpyrrolidone polymers tend to interact with the clays formulated therewith. Accordingly, the dye transfer inhibiting performance of the polymers and the softening performance of the clays are negatively affected.

It has now been found that polyamine N-oxide containing polymers are very compatible with clays in that the dye transfer inhibiting performance of the polyamine N-oxide containing polymers is not negatively affected in the presence of clays. In addition, it has been found that the softening performance of clays formulated with polyamine N-oxide containing polymers has been maintained.

This finding allows us to formulate detergent compositions which have both excellent dye transfer inhibiting properties and softening performance.

According to another embodiment of this invention a process is also provided for laundering operations involving colored fabrics.

Copending European Patent Application No. 92202168.8 describes polyamine N-oxide containing polymers which are very efficient in eliminating transfer of solubilized or suspended dyes.

SUMMARY OF THE INVENTION

The present invention relates to inhibiting dye transfer compositions comprising polyamine N-oxide containing polymers and a clay softening system.

DETAILED DESCRIPTION OF THE INVENTION

The compositions of the present invention comprise as an essential element a polymer selected from polyamine N-oxide containing polymers which contain units having the following structure formula:

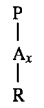

(I)

wherein P is a polymerisable unit, whereto the N—O group can be attached to or wherein the N—O group forms part of the polymerisable unit or a combination of both.

A is NC(=O), CO(=O), C(=O), —O—, —S—, —N(R)—; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

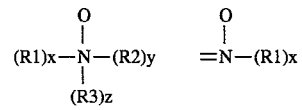

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxide containing polymers wherein R is selected from aliphatic, aromatic, allcyclic or heterocyclic groups.

One class of said polyamine N-oxide containing polymers comprises the group of polyamine N-oxides wherein the nitrogen of the N—O group forms part of the R-group. Preferred polyamine N-oxide containing polymers are those wherein R is a heterocyclic group such as pyridine, pyrrole, imidazole, pyrrolidine, piperidine, quinoline, acridine and derivatives thereof.

Another class of said polyamine N-oxide containing polymers comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyridine, pyrrole, imidazole and derivatives thereof.

Another preferred class of polyamine N-oxides are the polyamine N-oxide containing polymers having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide containing polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymers can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

The polyamine N-oxide containing polymers of the present invention are typically present from 0.001 to 10%, more preferably from 0.01 to 2%, most preferred from 0.05 to 1% by weight of the dye transfer inhibiting composition.

The present compositions are conveniently used as additives to conventional detergent compositions for use in laundry operations. The present invention also encompasses dye transfer inhibiting compositions which will contain detergent ingredients and thus serve as detergent compositions.

Methods for making polyamine N-oxides

The production of the polyamine-N-oxides may be accomplished by polymerizing the amine monomer and oxidizing the resultant polymer with a suitable oxidizing agent, or the amine oxide monomer may itself be polymerized to obtain the polyamine N-oxide.

The synthesis of polyamine N-oxide can be exemplified by the synthesis of polyvinyl-pyridine N-oxide.

Poly-4-vinylpyridine ex Polysciences (mw. 50 000, 5.0 g., 0.0475 mole) was predisolved in 50 ml acetic acid and treated with a peracetic acid solution (25 g of glacial acetic acid, 6.4 g of a 30% vol. solution of $H_2O_2$, and a few drops of $H_2SO_4$ give 0.0523 mols of peracetic acid) via a pipette. The mixture was stirred over 30 minutes at ambient temperature (32 C.). The mixture was then heated to 80–85 C. using an oil bath for 3 hours before allowing to stand overnight. The polymer solution then obtained is mixed with 11 of acetone under agitation. The resulting yellow brown viscous syrup formed on the bottom is washed again with 11 of aceton to yield a pale crystalline solid.

The solid was filtered off by gravity, washed with acetone and then dried over $P_2O_5$.

The amine: amine N-oxide ratio of this polymer is 1:4.

The clay softening system

The clay softening system comprises a fabric softening clay and may additionally comprise a clay flocculating agent and/or a humectant.

The fabric softening clay

The clay softening system hereof will comprise a fabric softening clay present in an amount of at least 0.5%, preferable from 4% to 30% by weight of the dye transfer inhibiting composition. The preferred clays are of the smectite type.

Smectite type clays are widely used as fabric softening ingredients in detergent compositions. Most of these clays have a cation exchange capacity of at least 50 meq./100 g.

Smectite clays can be described as three-layer expandable materials, consisting of alumino-silicates or magnesium silicates.

There are two distinct classes of smectite-type clays; in the first, aluminium oxide is present in the silicate crystal lattice, in the second class of smectites, magnesium oxide is present in the silicate crystal lattice.

The general formulas of these smectites are $Al_2(Si_2O_5)_2(OH)_2$ and $Mg_3(Si_2O_5)$ $(OH)_2$, for the aluminium and magnesium oxide type clay, respectively. The range of the water of hydration can vary with the processing to which the clay has been subjected. Furthermore, atom substitution by iron and magnesium can occur within the crystal lattice of the smectites, while metal cations such as $Na^+$, $Ca^{2+}$, as well as $H^+$can be co-present in the water of hydration to provide electrical neutrality.

It is customary to distinguish between clays on the basis of one cation predominantly or exclusively absorbed. For example, a sodium clay is one in which the absorbed cation is predominantly sodium. Such absorbed cations can become involved in equilibrium exchange reactions with cations present in aqueous solutions. In such equilibrium reactions, one equivalent weight of solution cation replaces an equivalent of sodium, for example, and it is customary to measure clay cation exchange capacity in terms of milliequivalents per 100 g. of clay (meq/100 g.).

The cation exchange capacity of clays can be measured in several ways, including electrodialysis, by exchange with ammonium ion followed by titration, or by a methylene blue procedure, all as set forth in Grimshaw, The Chemistry and Physics of Clays, Interscience Publishers, Inc. pp. 264–265(1971). The cation exchange capacity of a clay mineral relates to such factors as the expandable properties of the clay, the charge of the clay, which in turn, is determinated at least in part by the lattice structure, and the like. The ion exchange capacity of clays varies widely in the range from about 2 meq/100 g. for kaolinites to about 150 meq/100 g., and greater, for certain clays of the montmorillonite variety. Illite clays have an ionexchange capacity somewhere in the lower portion of the range, ca. 26 meq/100 g. for an average illite clay.

It has been determined that illite and kaolinite clays, with their relatively low ion exchange capacities, are not useful in the instant compositions. Indeed such illite and kaolinite clays constitute a major component of clay soils. However, smectites, such as nontronite having an ionexchange capacity of approximately 50 meq/100 g.; saponite, which has an ion exchange capacity greater than 70 meq/100 g., have been found to be useful fabric softeners.

The smectite clays commonly used for this purpose herein are all commercially available. Such clays include, for example, montmorillonite, volchonskoite, nontronite, hectorite, saponite, sauconite, and vermiculite. The clays herein are available under commercial names such as "fooler clay" (clay found in a relatively thin vein above the main bentonite or montmorillonite veins in the Black Hills) and various tradenames such as Thixogel #1 (also, "Thixo-Jell") and Gelwhite GP from Georgia Kaolin Co. Elizabeth, N.J.; Volclay BC and Volclay #325, from American Colloid Co., Skokie, Ill.; Black Hills Bentonite BH 450, from International Minerals and Chemicals; and Veegum Pro and Veegum F, from R.T. Vanderbilt. It is to be recognized that such smectite-type minerals obtained under the foregoing commercial and tradenames can comprise mixtures of the various discrete mineral entitites. Such mixtures of the smectite minerals are suitable for use herein.

Preferred for use herein are the montmorrillonite clays.

Quite suitable are hectorites of natural origin, in the form of particles having the general formula $$[(Mg_{3-x}Li_x)Si_{4-y}Me_yO_{10}(OH_{2-z}F_z)]^{-(x+y)}\frac{(x+y)}{\eta}M^{n+} \quad \text{III}$$

wherein $Me^{III}$ is Al, Fe, or B; or B; or y=o; $M^{n+}$ is a monovalent (n=1) or divalent (n=2) metal ion, for example selected from Na, K, Mg, Ca, Sr.

In the above formula, the value of (x+y) is the layer charge of the hectorite clay.

Such hectorite clays are preferably selected on the basis of their layer charge properties, i.e. at least 50% is in the range of from 0.23 to 0.31.

More suitable are hectorite clays of natural origin having a layer charge distribution such that at least 65% is in the range of from 0.23 to 0.31.

The hectorite clays suitable in the present composition should preferably be sodium clays, for better softening activity.

Sodium clays are either naturally occuring, or are naturally-occuring calcium-clays which have been treated so as to convert them to sodium-clays. If calcium-clays are used in the present compositions, a salt of sodium can be added to the compositions in order to convert the calcium clay to a sodium clay. Preferably, such a salt is sodium carbonate, typically added at levels of up to 5% of the total amount of clay.

Examples of hectorite clays suitable for the present compositions include Bentone EW and Macaloid, from NL Chemicals, N.J., U.S.A., and hectorites from Industrial Mineral Ventures.

Clay-flocculating agents

The clay softening system herein can comprise clay-flocculating agents. The compositions herein may comprise, from 0.05% to 20% by weight of the clay, of flocculating agent, if its molecular weight is 150.000–800.000 and from 0.005% to 2%, by weight of the clay, it its molecular weight is from 800.000 to 5 million. Most of these materials are fairly long chain polymers and copolymers derived from such monomers as ethylene oxide, acrylamide, acrylic acid, dimethylamino ethyl methacrylate, vinyl alcohol, vinyl pyrrolidone, ethylene imine. Gums, like guar gum, are suitable as well.

Preferred are polymers of ethylene oxide, acryl amide, or acrylic acid. For proper interaction with the clay particles, the polymers should be fairly long chain, i.e., have a weight average molecular weight of at least 100,000. For sufficient water-solubility the weight average molecular weight of the polymers should not exceed 10 million. Most preferred are polymers having a weight average molecular weight of from 150.000 to 5 million.

The humectant

The organic humectant optionally employed in the clay agglomerates herein, may be any of the various water soluble materials utilized for such a purpose. The organic humectant is preferably selected from the group consisting of a) aliphatic hydrocarbon polyols having from 2 to 9 carbon atoms; b) ether alcohols derived from the polyols of a); c) ester alcohols derived from the polyols of a); d) mono- and oligosaccharides; and mixtures thereof.

Highly preferred humectants include glycerol, ethylene glycol, propylene glycol and the dimers and trimers of glycerol, of ethylene glycol and of propylene glycol.

The clay softening system can comprise from 0.5% to 30%, preferably from 2% to 15%, of the humectant by weight of the clay.

DETERGENT ADJUNCTS

A wide range of surfactants can be used in the detergent compositions. A typical listing of anionic, nonionic, ampholytic and zwitterionic classes, and species of these surfactants, is given in Norris U.S. Pat. No. 3,664,961 issued on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\,(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

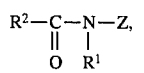

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and and carboxymethyl derivatives of polyhydric alcohols such as sorbitol, mannitol and xylitol. Aromatic polycarboxylates include mellitic acid, pyromellitic acid and the phtalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (sks/6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Especially for the liquid execution herein, suitable fatty acid builders for use herein are saturated or unsaturated C10–18 fatty acids, as well as well as the corresponding soaps. Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions the purposes of the invention include inorganic materials such as alkali metal carbonates, bicarbonates, silicates, and organic materials such as the organic phosphonates, amiono polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Detergent ingredients that can be included in the detergent compositions of the present invention include bleaching agents.

These bleaching agent components can include one or more oxygen bleaching agents and, depending upon the bleaching agent chosen, one or more bleach activators. When present bleaching compounds will typically be present at levels of from about 1% to about 10%, of the detergent composition. In general, bleaching compounds are optional components in non-liquid formulations, e.g. granular detergents. If present, the amount of bleach activators will typically be from about 0.1% to about 60%, more typically from about 0.5% to about 40% of the bleaching composition.

The bleaching agent component for use herein can be any of the bleaching agents useful for detergent compositions including oxygen bleaches as well as others known in the art.

In a method aspect, this invention further provides a method for cleaning fabrics, fibers, textiles, at temperatures below about 50° C., especially below about 40° C., with a detergent composition containing polyamine N-oxide containing polymers, optional auxiliary detersive surfactants, optional detersive adjunct ingredients, and a bleaching agent.

The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include-6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

Preferably, the bleaches suitable for the present invention include peroxygen bleaches. Examples of suitable water-soluble solid peroxygen bleaches include hydrogen peroxide releasing agents such as hydrogen peroxide, perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters (ATC) such as disclosed in Copending European Patent Application No. 91870207.7.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.025% to about 1.25%, by weight, of sulfonated zinc phthalocyanine.

Other detergent ingredients that can be included are detersive enzymes which can be included in the detergent formulations for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of *B. subtilis* and *B. licheniforms*. Proteolytic enzymes suitable for removing protein-based stains that are commercially available include those sold under the tradenames Alcalase, Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A is described in European Patent Application 130,756. Protease B is described in European Patent Application Serial No. 87303761.8. Amylases include, for example,—amylases obtained from a special strain of *B. licheniforms*, described in more detail in British Patent Specification No. 1,296,839 (Novo). Amylolytic proteins include, for example, Rapidase, Maxamyl (International Bio-Synthetics, Inc.) and Termamyl, (Novo Industries).

The cellulases usable in the present invention include both bacterial or fungal cellulase. Preferably, they will have a pH optimum of between 5 and 9.5. Suitable cellulases are disclosed in Barbesgoard et al U.S. Pat. No. 4,435,307, which discloses fungal cellulase produced from *Humicola insolens*. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (*Dolabella Auricula Solander*).

Other suitable cellulases are cellutases originated from *Humicola Insulens* having a molecular weight of about 50 KDa, an isoelectric point of 5.5 and containing 415 amino acids. Such cellulase are described in Copending European patent application No. 93200811.3, filed Mar. 19, 1993.

Especially suitable cellulase are the cellulase having color care benefits. Examples of such cellulases are cellulase described in European patent application No. 91202879.2, filed Nov. 6, 1991 Carezyme (Novo).

Suitable lipase enzymes for detergent usage include those produced by microorganisms of the Pseudomonas group, such as *Pseudomonas stutzeri* ATCC 19.154, as disclosed in British Patent 1,372,034. Suitable lipases include those which show a positive immunoligical cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P".

Especially suitable Lipase are lipase such as M1 Lipase (Ibis) and Lipolase (Novo).

Peroxidase enzymes are used in combination with oxygen sources, e.g. percarbonate, perborate, persulfate, hydrogen peroxide, etc. They are used for "solution bleaching", i.e. to prevent transfer of dyes of pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT Internation Application WO 89/099813 and in European Patent application EP No. 91202882.6, filed on Nov. 6, 1991.

In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818. It has also been proposed to use polyols like glycerol and sorbitol. Alkoxyalcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. No. 4,261,868, U.S. Pat. No. 3,600,319, and European Patent Application Publication No. 0 199 405, Application No. 86200586.5. Non-boric acid and borate stabilizers are preferred. Enzyme stabilization systems are also described, for example, in U.S. Pat. Nos. 4,261,868, 3,600,319 and 3,519,570.

Other suitable detergent ingredients that can be added are enzyme oxidation scavengers which are described in Copending European Patent aplication N 92870018.6 filed on Jan. 31, 1992. Examples of such enzyme oxidation scavengers are ethoxylated tetraethylene polyamines.

Especially preferred detergent ingredients are combinations with technologies which also provide a type of color care benefit. Examples of these technologies are cellulase and/or peroxidases and/or metallo catalysts for color maintance rejuvenation.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alcanols are 2-butyl-octanol which are commercially available under the trade name Isofol 12 R.

Such suds suppressor system are described in Copending European Patent application N 92870174.7 filed 10 Nov. 1992.

Especially preferred silicone suds controlling agents are described in Copending European Patent application No. 92201649.8

Said compositions can comprise a silicone/silica mixture in combination with fumed nonporous silica such as Aerosil®.

The suds suppressors described above are normally employed at levels of from 0.001% to 2% by weight of the composition, preferably from 0.01% to 1% by weight.

Other components used in detergent compositions may be employed, such as soil-suspending agents soil-release agents, optical brighteners, abrasives, bactericides, tarnish inhibitors, coloring agents, and non-encapsulated and encapsulated perfumes.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4$^1$-bis-(2-diethanolamino-4-anilino-s-triazin-6-ylamino)stilbene-2:2$^1$ disulphonate, disodium 4,-4$^1$-bis-(2-morpholino-4-anilino-s-triazin-6-ylaminostilbene-2:2$^1$-disulphonate, disodium 4,4$^1$-bis-(2,4-dianilino-s-triazin-6-ylamino) stilbene-2:2$^1$-disulphonate, monosodium 4$^1$,4$^{11}$-bis-(2,4-dianilino-s-triazin-6-ylamino)stilbene-2-sulphonate, disodium 4,4$^1$-bis-(2-anilino-4-(N-methyl-N-2-hydroxyethylamino)-s-triazin-6-ylamino)stilbene-2,2$^1$-disulphonate, disodium 4,4$^1$-bis-(4-phenyl-2,1,3-triazol-2-yl)-stilbene-2,2$^1$ disulphonate, disodium 4,4$^1$bis(2-anilino-4-(1-methyl-2-hydroxyethylamino)-s-triazin-6-ylamino)stilbene-2,2$^1$disulphonate and sodium 2(stilbyl-4$^{11}$-(naphtho-1$^1$,2$^1$:4,5)-1,2,3-triazole-2$^{11}$-sulphonate.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $(CH_3(PEG)_{43})_{0.75}(POH)_{0.25}[T\text{-}PO)_{2.8}(T\text{-}PEG)_{0.4}]T(PO\text{-}H)_{0.25}((PEG)_{43}CH_3)_{0.75}$ where PEG is —$(OC_2H_4)O$—, PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1-2 propane diol, the end groups consisting primarily of sulphobenzoate and secondarily of mono esters of ethylene glycol and/or propanediol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1-2 diol, thereof consist "secondarily" of such species.

The selected polyesters herein contain about 46% by weight of dimethyl terephtalic acid, about 16% by weight of propane—1.2 diol, about 10% by weight ethylene glycol about 13% by weight of dimethyl sulfobenzoid acid and about 15% by weight of sulfoisophtalic acid, and have a molecular weight of about 3.000. The polyesters and their method of preparation are described in detail in EPA 311 342.

The detergent compositions according to the invention can be in liquid, paste, gels or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "concentrated form", in such case, the liquid detergent compositions according to the present invention will contain a lower amount of water, compared to conventional liquid detergents. Typically, the water content of the concentrated liquid detergent is less than 30%, more preferably less than 20%, most preferably less than 10% by weight of the detergent compositions.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. and higher temperatures. The pH of the treatment solution is preferably from 7 to 11, especially from 7.5 to 10.5.

The process and compositions of the invention can also be used as detergent additive products.

Such additive products are intended to supplement or boost the performance of conventional detergent compositions.

The detergent compositions according to the present invention include compositions which are to be used for cleaning substrates, such as fabrics, fibers, hard surfaces, skin etc., for example hard surface cleaning compositions (with or without abrasives), laundry detergent compositions, automatic and non automatic dishwashing compositions.

The following examples are meant to exemplify compositions of the present invention, but are not necessarily meant to limit or otherwise define the scope of the invention, said scope being determined according to claims which follow.

The overall detergency performance of the compositions was assessed by measuring the dye transfer inhibiting performance and softening performance.

The extent of dye transfer from different colored fabrics was studied using a launder-o-meter test that simulates a 30 min wash cycle. The launder-o-meter beaker contains a 10 cm×10 cm piece of the colored fabric and a multifiber swatch which is used as a pick-up tracer for the bleeding dye. The multifiber swatch consists of 6 pieces (1.5 cm×5 cm each) of different material (polyacetate, cotton, polyamide, polyester, wool and orlon) which are sewn together. The hardness of the water was –2 mM Calcium and the composition concentration was 0.7% in the wash liquor.

The extent of dye transfer is assessed by a Hunter Colour measurement. The Hunter Colour system evaluates the colour of a fabric sample in terms of the DE value which represents the change in the Hunter L, a, b, values which are determined by reflecting spectrophotometer. The DE value is defined by the following equation:

$$DE=\{(a_f-a_i)^2+(b_f-b_i)^2+(L_f-L_i)^2\}^{1/2}$$

where the subscripts i and f refer to the Hunter value before and after washing in the presence of the bleeding fabric, respectively. The least significant difference is 1 at 95% confidence level.

The softening performance was measured by a launder-ometer test. The test procedure was as follows: 3.5 kg of clean fabric laundry loads were washed in an automatic drum washing machine Miel 423 at 60° C. The hardness of the water was 2 mM Calcium and the composition concentration was 0.7% in the wash liquor.

A bundle of soiled fabrics containing fabrics which were stained with particulate soil was split into two parts and each part was washed in with a detergent composition containing a N-vinylimidazole N-vinylpyrrolidone copolymer. Comparative cleaning assessment was done by expert judges using a scale of 0 to 4 panel-score-units (PSU). In this scale 0 is given for no difference and 4 is given for maximum difference. Softening was assessed after 4 wash cycles.

A granular detergent composition according to the present invention is prepared, having the following compositions:

TABLE I

| % by weight of the total detergent composition | |
|---|---|
| Linear alkyl benzene sulphonate | 13.70 |
| Tallow alkyl sulphate | 5.9 |
| $C_{45}$ alcohol 7 times ethoxylated | 4.00 |
| Trisodium citrate | 5.00 |
| Zeolite | 26.00 |
| Maleic acid actylic acid copolymer | 4.9 |
| Diethylenetriaminepentamethylene Phosphonic acid | 0.6 |
| Protease | 1.5 |
| carboxymethylcellulose | 1.5 |
| suds supressor (silicone) | 0.3 |

EXAMPLE I/II

Example I and II demonstrate the dye transfer inhibiting performance of the polyamine N-oxide containing polymers in combination with the clays versus dye transfer inhibiting compositions containing (PVP) polyvinylpyrrolidone and clay.

Experimental conditions pH=8.5

Wash Temperature: 40° C.

EXAMPLE I (A/B/C/D)

A: A detergent composition according to Table I which contains no Clay softening system and no PVP.

B: A detergent composition according to Table I which contains 12.5% of a clay softening system and no PVP.

C: A detergent composition according to Table I containing 1.5% of PVP (polyvinylpyrrolidone) which has an average molecular weight of about 30,000 and no clay.

D: A detergent composition according to Table I containing 1.5% of PVP which has an average molecular weight of about 30,000 and 12.5% of a clay softening system

EXAMPLE II (A/B/C/D)

A: A detergent composition according to Table I which contains no Clay softening system and no PVNO (poly(4-vinylpyridine-N-oxide).

B: A detergent composition according to Table I which contains 12.5% of a clay softening system and no PVNO (poly(4-vinylpyridine-N-oxide).

C: A detergent composition according to Table I containing 10 ppm of PVNO (poly(4-vinylpyridine-N-oxide)) which has an average molecular weight of about 30,000 and an amine to amine N-oxide ratio of 1:5 (measured by NMR) and no clay.

D: A detergent composition according to Table I containing 10 ppm of PVNO (poly(4-vinylpyridine-N-oxide)) which has an average molecular weight of about 30,000 and an amine to amine N-oxide ratio of 1:5 (measured by NMR) and 12.5% of a clay softening system Results D(DE) values (DE(test)–DE(reference)) for the cotton pick-up tracer. (reference respectively IA and IIA (Bleeding fabric color: Direct Brown 90;

Bleeding fabric composition: 100% cotton) and PSU values

| | IB | IC | ID | IIB | IIC | IID |
|---|---|---|---|---|---|---|
| D(DE) | 0 | 14 | 0 | 0 | 14 | 14 |
| PSU | 2 | 0 | 0 | 2 | 0 | 2 |

The above results demonstrate that the combination of the polyamine-N-oxide containing polymers and clay provides both excellent dye transfer inhibition and softening performance.

EXAMPLE III (A/B/C)

A liquid detergent composition according to the present invention is prepared, having the following compositions:

| | % by weight of the total detergent composition | | |
|---|---|---|---|
| | A | B | C |
| Linear alkylbenzene sulfonate | 10 | — | — |
| Polyhydroxy fatty acid amide | — | 5 | — |
| Alkyl alkoxylated sulfate | — | — | 9 |
| Alkyl sulphate | 4 | 8 | 4 |
| Fatty alcohol ($C_{12}$—$C_{15}$) ethoxylate | 12 | 12 | 12 |
| Fatty acid | 10 | 10 | 10 |
| Oleic acid | 4 | 4 | 4 |
| Citric acid | 1 | 1 | 1 |
| Diethylenetriaminepentamethylene Phosphonic acid | 1.5 | 1.5 | 1.5 |
| NaOH | 3.4 | 3.4 | 3.4 |
| Propanediol | 1.5 | 1.5 | 1.5 |
| Ethanol | 10 | 10 | 10 |
| Ethoxylated tetraethylene pentamine | 0.7 | 0.7 | 0.7 |
| Poly(4-vinylpyridine)-N-oxide | 0–1 | 0–1 | 0–1 |
| Termamyl R 300 KNU/g | 0.1 | 0.1 | 0.1 |
| Carezyme R 5000 CEVU/g | 0.02 | 0.02 | 0.02 |
| Protease 40 mg/g | 1.8 | 1.8 | 1.8 |
| Lipolase R 100 KLU/g | 0.14 | 0.14 | 0.14 |
| Endoglucanase A 5000 CEVU/g | 0.4 | 0.4 | 0.4 |
| Suds supressor (ISOFOL[f]) | 2.5 | 2.5 | 2.5 |
| $H_2O_2$ | — | — | 7.5 |
| clay | 4 | 4 | 4 |
| Minors | | up to 100 | |

EXAMPLE IV (A/B/C)

A compact granular detergent composition according to the present invention is prepared, having the following formulation:

| | % by weight of the total detergent composition | | | | |
|---|---|---|---|---|---|
| | A | B | C | D | E |
| Linear alkyl benzene sulphonate | 11.40 | — | — | — | 5 |
| Polyhydroxy fatty acid amide | — | 10 | — | 5 | 5 |
| Alkyl alkoxylated sulfate | — | — | 9 | 9 | 9 |
| Tallow alkyl sulphate | 1.80 | 1.80 | 1.80 | 4 | 4 |
| $C_{45}$ alkyl sulphate | 3.00 | 3.00 | 3.00 | — | — |
| $C_{45}$ alcohol 7 times ethoxylated | 4.00 | 4.00 | 4.00 | — | — |
| Tallow alcohol 11 times ethoxylated | 1.80 | 1.80 | 1.80 | 5 | 5 |
| Dispersant | 0.07 | 0.07 | 0.07 | 0.07 | 0.07 |
| Silicone fluid | 0.80 | 0.80 | 0.80 | 0.80 | 0.80 |
| Trisodium citrate | 14.00 | 14.00 | 14.00 | 14.00 | 14.00 |
| Citric acid | 3.00 | 3.00 | 3.00 | 3.00 | 3.00 |
| Zeolite | 32.50 | 32.50 | 32.50 | 32.50 | 32.50 |
| Maleic acid acrylic acid copolymer | 5.00 | 5.00 | 5.00 | 5.00 | 5.00 |
| Cellulase (active protein) | 0.03 | 0.03 | 0.03 | 0.03 | 0.03 |
| Alkalase/BAN | 0.60 | 0.60 | 0.60 | 0.60 | 0.60 |
| Lipase | 0.36 | 0.36 | 0.36 | 0.36 | 0.36 |
| Sodium silicate | 2.00 | 2.00 | 2.00 | 2.00 | 2.00 |
| Sodium sulphate | 3.50 | 3.50 | 3.50 | 3.50 | 3.50 |
| Poly(4-vinylpyridine)-N-oxide | 0–1 | 0–1 | 0–1 | 0–1 | 0–1 |
| Perborate | — | — | — | 15 | — |
| TAED | | — | | 5 | 5 |
| Percarbonate | — | — | — | | 20 |
| Clay | 10 | 10 | 10 | 10 | 10 |
| Minors | | | up to 100 | | |

The above compositions (Example II (A/B/C) and III (A/B/C)) were very good at displaying excellent softening, cleaning and detergency performance with outstanding color-care performance on colored fabrics and mixed loads of colored and white fabrics.

We claim:

1. A dye transfer inhibiting fabric softening composition comprising a) 0.0001% to 10% by weight of poly(4-vinylpyridine-N-oxide) having a ratio of amine to amine N-oxide of from about 2:3 to about 1:1,000,000; and b) 0.5% to 30% by weight of a fabric softening clay.

2. A dye transfer inhibiting fabric softening composition according to claim 1 in the form of a non-dusting granule or a liquid.

3. A dye transfer inhibiting fabric softening composition according to claim 1 which additionally comprises surfactants, builders, chelants, bleaching agents, soil-suspending agents, suds suppressors, soil release agents, optical brighteners, abrasives, bactericides, tarnish inhibitors, coloring agents, perfumes or mixtures thereof.

* * * * *